US007779741B2

(12) United States Patent
Polston

(10) Patent No.: US 7,779,741 B2
(45) Date of Patent: Aug. 24, 2010

(54) SEMI-AUTOMATIC FIRING CLOSED BOLT-TYPE CARBINE ANTI-JAMMING CARTRIDGE LOADING SYSTEM

(75) Inventor: Timothy J. Polston, Jacksonville, AR (US)

(73) Assignee: SA Ordnance LLC, Tierra Verde, FL (US)

( * ) Notice: Subject to any disclaimer, the term of this patent is extended or adjusted under 35 U.S.C. 154(b) by 402 days.

(21) Appl. No.: 11/947,101

(22) Filed: Nov. 29, 2007

(65) Prior Publication Data

US 2010/0180760 A1 Jul. 22, 2010

(51) Int. Cl.
*F41A 9/00* (2006.01)

(52) U.S. Cl. ..... 89/33.01; 42/46; 42/47; 89/179; 89/191.01; 89/194

(58) Field of Classification Search ..... 42/25, 42/46, 47; 89/179, 191.01, 191.02, 192, 89/194, 33.01, 182
See application file for complete search history.

(56) References Cited

U.S. PATENT DOCUMENTS 1,131,319 A 3/1915 Blish
3,292,492 A 12/1966 Sturtevant
4,358,986 A 11/1982 Giorgio
5,501,134 A 3/1996 Milazzo et al.
5,623,114 A 4/1997 Soper
2007/0266845 A1 11/2007 Polston

*Primary Examiner*—Michael Carone
*Assistant Examiner*—Jonathan C Weber
(74) *Attorney, Agent, or Firm*—Larson + Larson, P.A.; James E. Larson

(57) ABSTRACT

A semi-automatic firing carbine anti-jamming cartridge loading system is provided wherein no feed lips or a portion of said feed lips are removed, wherein the cartridge to be loaded is fed to the carbine breech along a feed ramp. A bolt enclosing the firing pin includes a pivot plate mounted on the bolt nose, rotating about an axle. A recess formed in the bolt nose provides spacing for the pivot plate to rotate about said axle. If the firing pin protrudes through an aperture formed in the pivot plate, while the pivot plate is still in its collapsed state, then the weapon will jam by the firing pin hanging on the top part of a rim portion of the next loading round, thereby thwarting attempts at reconfiguring the weapon, that employs my novel system, to be re-converted as a fully-automatic weapon.

20 Claims, 10 Drawing Sheets

SEMI-AUTOMATIC FIRING CLOSED BOLT-TYPE CARBINE ANTI-JAMMING CARTRIDGE LOADING SYSTEM

BACKGROUND OF THE INVENTION

1. Field of Invention

The present invention relates to a semi-automatic firing closed bolt-type carbine anti-jamming cartridge loading system. More particular, the invention relates to a system that eliminates the use of feed lips in its cartridge loading mechanism for prohibiting the carbine from firing in a fully-automatic mode in the event that the firing pin becomes fixed for any reason in the fire position, but still permits the carbine to load a new cartridge for single fire action without jamming, so long as the trigger is re-pulled each time to fire each single round and the firing pin is recessed within the bolt as in a proper operating single-firing weapon.

2. Description of the Prior Art

In the United States, it is not unlawful in many States to own a fully-automatic firing weapon, or what most people refer to as a "machine gun." In fact, in recent years, it has become an active and prolific hobby with mostly wealthy gun enthusiasts, gun collectors and investors. Some well known and famous machine guns of the $19^{th}$ and $20^{th}$ centuries can fetch upwards of $100,000.00 for a single weapon depending on the condition of the weapon and its rarity. However, prices such as these make it practically impossible for most people to own such a weapon under their Second Amendment Constitutional Rights. Further, some States severely regulate and even prohibit the ownership of fully-automatic weapons making it either harder or impossible to own such a weapon. Finally, even though the United States federal government may not prohibit the ownership of certain fully-automatic weapons, due to an inherent Second Amendment right under the United States Constitution, it has made the ownership, possession and transportation of such weapons more difficult. For instance, the proper license, granted by the Bureau of Alcohol, Tobacco, Firearms and Explosives (the "ATF") to an individual or corporation in the form of proof of payment of a tax, must always be "affixed" to the weapon at all times. Therefore, for all of these reasons, the chance of owning these weapons, let alone experiencing the firing of some of these famous weapons, is essentially unattainable for most citizens in the United States.

Because of the difficulties in which to legally own or even possess certain fully-automatic weapons, as set forth above, a market was born and has steadily grown over the last few years among gun enthusiasts and even collectors for "converted" machine guns which can only operate in a single fire mode or what is called in the art as a "semi-automatic" firing weapon. The distinction between fully automatic and semi-automatic modes is a simple one. A fully automatic weapon only needs to have pulled and held back its trigger one time, whereby the weapon will continue to fire until the trigger is released or the magazine or other cartridge supplying mechanism (i.e., belts and drums) run dry of cartridges. Conversely, a semi-automatic firing weapon must have its trigger pulled each and every time for firing each cartridge. Converted weapons have all the outward appearances of being a fully-automatic weapon, but in fact can only fire semi-automatic, in other words, in the single shot mode. The result of this semi-auto converted market has given many more gun enthusiasts and collectors the ability to own some of these famous weapons at a fraction of the cost, has eliminated the need to pay the special tax to the Federal government, has further alleviated the need to always carry the proof of payment of this special federal tax payment and has removed the burdensome and time consuming restrictions placed on the transfer of ownership of an otherwise fully automatic firing weapon.

Conversion of a fully-automatic firing weapon to a semi-auto firing weapon is not an easy endeavor. There are a multitude of different firing mechanisms employed within full-auto weapons, which make them operate in a specific manner. Therefore, depending on what gun is to be converted from a fully-automatic weapon to a semi-automatic weapon dictates how that the fully-automatic mode is disabled in a particular gun. And this has become a huge concern for the United States governmental agency responsible for the regulation and enforcement of federal laws dealing in illegal weapons. In fact, a quick review of the ATF web site reveals that a majority of the notices which it publishes concerning ATF enforcement activities, across the board for all areas of responsibility, relate to the enforcement of illegal firearms.

The United States government has a public safety interest in ensuring that fully-automatic weapons, notwithstanding that the weapons could be a lawful full-auto weapons, be converted to a semi-automatic weapon only pursuant to ATF approval. And as such, the ATF is very cooperative in providing guidelines and promulgating rules that inform citizens what must be done to make a converted weapon compliant. This ensures that the weapon will no longer be classified as a "machine gun" and therefore not be subject to the controls of the National Firearms Act of 1934 (the "NFA"), which regulates the transfer and ownership of all Title II weapons.

Specifically, the ATF requires that all persons or companies that legally desire to convert a fully-automatic weapon into a semi-automatic weapon, do so by either eliminating completely the possibility that such weapon can ever again be converted back to a fully-automatic weapon or by making it so difficult for that weapon to be re-converted back into fully-automatic mode, that any person wishing to engage in such illegal activity is deterred or sufficiently limited in their ability to do so.

As such, the ATF encourages people who legally wish to perform any fully to semi-automatic weapon conversion services, to submit their designs to the ATF for approval before embarking on such conversion. In doing so, the ATF will provide their helpful guidance as to which features must be eliminated from any specific weapon to be converted to semi-auto mode.

The ATF has determined and required, that a very popular weapon, which many gun enthusiasts and collector desire to own, the Thompson Submachine Gun (also known as the "Tommy Gun"), must have its feed lips removed if a person wants to legally convert such gun from its fully-automatic state to be a semi-automatic firing carbine. This is so for if the firing pin becomes locked in a firing position, the gun will jam for failure of the next cartridge to load within the breech area (in actuality, the cartridge will "hang" on the firing pin). But unfortunately, in removing the feed lips from said gun, this makes the Tommy Gun inoperable. This is because the Thompson Submachine Gun is designed with a less radical blow back action using a delayed or retarded blow back system known as the Blish Lock. Since a cartridge enters the firing chamber of a Thompson Submachine Gun on a feed ramp, in that the source of cartridges from the magazine or drum are slightly off-set from where the cartridges are placed for firing within the breech area, feed lips are required to place the cartridge in the proper firing position and to expel the spent shell casing of the previously fired round. If the lower parts of the feed lips are removed, as now required by ATF for this specific weapon, the gun will feed another round but will not expel the spent shell casing of the previously fired round and thereby cause the weapon to jam. This differs significantly from a weapon such as the Sten gun, which utilizes a type of immediate feed system (devoid of any feed ramps like a Thompson), a radical extraction method and does not employ a delayed blow back bolt. Hence, the reason that no feed lips are required on a Sten gun.

This requirement of ATF (the removal of the feed lips), to date, has made it impossible for an original Thompson Submachine Gun to be converted legally to a semi-auto carbine, since once the feed lips are removed, the gun will only chamber and fire the first round. Thereafter, it will jam. This essentially renders the gun useless and valueless to collectors and enthusiasts. Of course replicas of Thompson Submachine Guns are already made available for purchase as a semi-automatic carbine. But these guns have been fabricated new from non-original parts and employ completely different internal parts than that of the original Thompson. These guns are generally of no interest to true gun enthusiasts and collectors as they have no real investment value.

Therefore, there is a need for an improved cartridge loading system, which prohibits jamming of a converted closed bolt semi-automatic carbine, such as an original converted 1928 or 1921 Thompson submachine gun, and other guns that work on the similar principle of the delayed blow back bolt.

SUMMARY OF THE INVENTION

I have invented an anti-jamming cartridge loading system for use in a closed bolt-type carbine that employs a delayed blow back system for firing a single round, expelling the used cartridge shell casing, and for loading a subsequent round to be fired. However, my loading system is employed only with guns that fire in a single fire mode, wherein the person using said weapon must pull the trigger each time to fire a single round. However, my inventive system can be employed to convert a fully-automatic weapon into a semi-automatic weapon such that it is compliant under United States law but not subject to the NFA.

My loading system employs no feed lips, like those found on, inter alia, an original Thompson submachine gun. My loading system employs a novel pivoting plate (which I term the "rock and lock") which pivots upon a fixed pin on an end (or nose) of the bolt of a single fire carbine or a fully-automatic weapon that has been modified to only fire in a single fire mode. If my pivoting plate is used as part of a conversion kit to convert a fully-automatic weapon to a semi-automatic weapon, the weapon is prevented from firing in full automatic mode if the firing pin becomes fixed by jamming the gun after firing the first round. However, here to date, this could not be accomplished in a weapon of this type if the feed lips were removed as the ATF now requires. Therefore, my novel system is the first system to prevent such a weapon, using a delayed blow back bolt, from firing in fully automatic mode in the event the firing pin becomes fixed.

The fully automatic fire mode is prevented in my loading system by jamming the subsequent round on the feed ramp (i.e., protruding firing pin wedges itself above the rim of the cartridge before the pivoting plate has had an opportunity to place the round in the firing chamber). No pressure is exerted on the fixed pin (or axle) of the pivoting plate when the bolt is moving forward and chambering a round because the pivoting plate is in a collapsed state which causes it to bottom-out against its seat in a recessed portion of the bolt.

However, presuming the weapon is operating properly in its single fire mode (in other words, there has been no attempted circumvention of the single fire mode to make the weapon full fire), as the cartridge slides up the feed ramp, it slides into a lower portion of the pivoting plate, which then pivots on its axle and thereby rotates upward and assists to carry the round into the firing chamber (presuming of course that the firing pin is recessed).

When the cartridge reaches the top of the feed ramp and is being inserted into the chamber of the weapon, its rim is forced underneath the extractor of the weapon, instead of the usual way wherein the extractor is forced to snap over the outside of the rim by force of the bolt inertia created by the force of the recoil spring. A slight modification to the extractor in the present invention is necessary to accomplished this.

Notable in my novel cartridge loading system, is that the pivot point for the pivoting plate is below the center line (or center axis) of the bolt firing pin. The pivoting plate axle is also off-set by about 10° ccw.

When the cartridge is fully seated within the breech and the bolt is at "closed battery" position, the top portion of the pivoting plate is forced against its seat in the recess formed therein. This results in no pressure being exerted upon the pivot pin (axle) of the pivoting plate. At this given moment, the lip on the bottom portion of the pivoting plate has "locked" the cartridge in place by its upwardly pivoting action. Then, upon firing, the bolt is forced rearwardly against the recoil spring after a slight delay from the Blish lock. The extractor on the tip of the bolt catches the edge of the empty shell casing and ejects it out through the ejector slot of the weapon. Only at this time, is there any pressure placed upon the axle of the pivoting plate. But the amount of pressure is minimal in terms of the axle's strength and thereby does not affect the axles fixed position.

As stated before, if for any reason the firing pin is not recessed but instead jutting outwardly through the bolt, the subsequent round will jam (at a top portion of the rim area) with the tip of the firing pin before the pivoting plate has carried the round fully into the chamber.

BRIEF DESCRIPTION OF THE DRAWINGS

The detailed description of the invention, contained herein below, may be better understood when accompanied by a brief description of the drawings, wherein.

DETAILED DESCRIPTION OF THE PREFERRED EMBODIMENT

Figure 1:
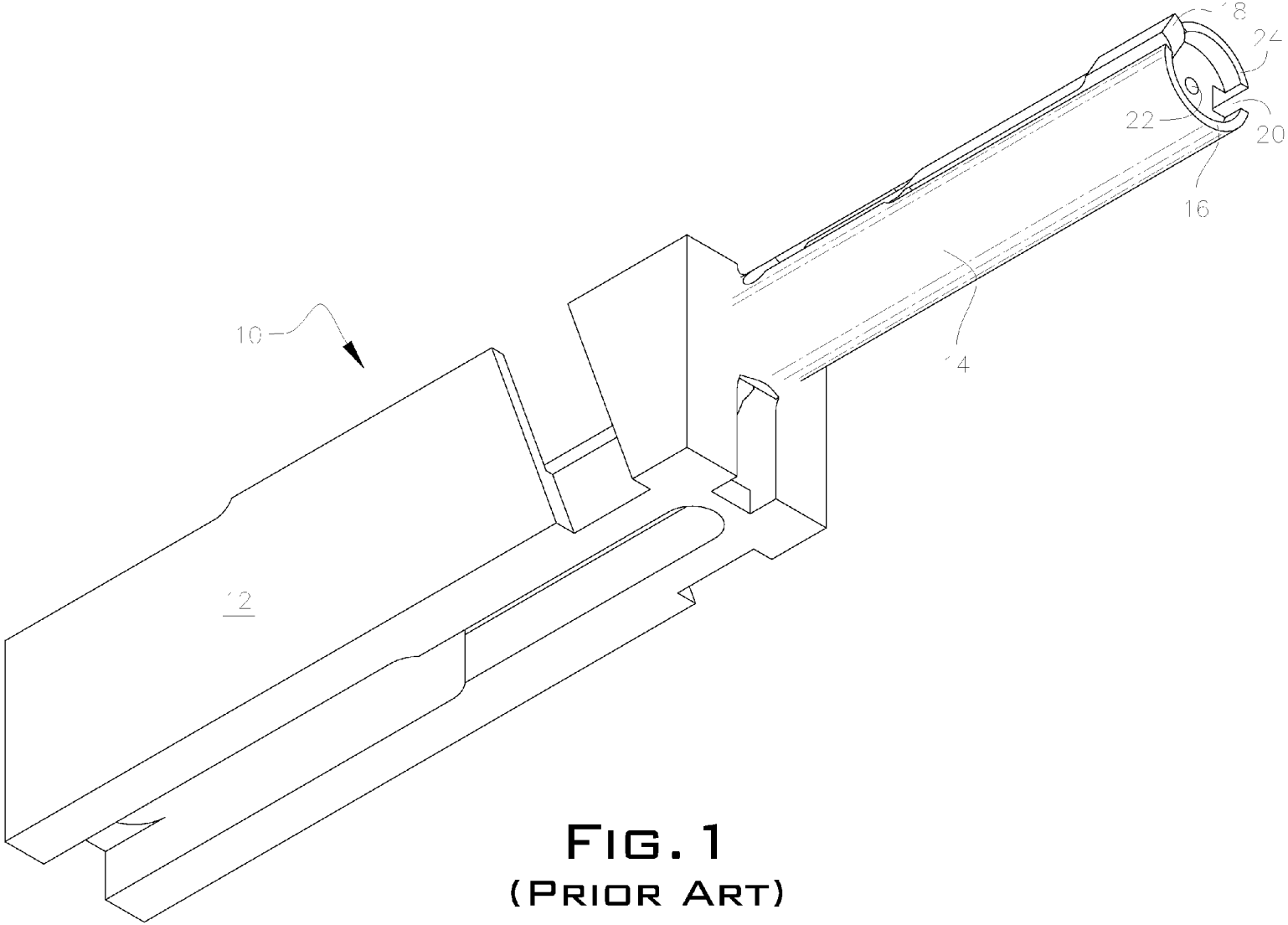
FIG. 1 (PRIOR ART)
FIG. 1 is a perspective view of a bolt used in weapon employing a delayed blow back system before having a top portion modified with a novel pivoting plate of the present invention.

Referring to FIG. 1, a bolt 10 is shown that can be used in a weapon that employs a delayed blow back system (i.e., the Blish lock) for firing a round, extracting a spend shell casing and loading a new round to be fired. Bolt 10 has a main body portion 12 and a forward extending elongated cylindrical portion 14, which employs a tip portion 16 (or bolt nose). As shown in FIG. 1, the tip portion includes an extractor 18 and a spent shell casing ejector slot 20. This bolt 10 is one that can be modified to provide my novel anti-jamming cartridge loading system for use in a semi-automatic firing carbine. It is important to note that the bolt 10 shown herein is actually one created by me for the purpose of another invention, before the U.S. PTO in U.S. patent application Ser. No. 11/435,402, now U.S. Pat. No. 7,562,614, filed May 17, 2006. Incorporation by reference is made to the disclosure therein to explain the novel aspects of that separate invention as well as certain operational single-fire capabilities of the present invention set forth in this application.

Figure 2:
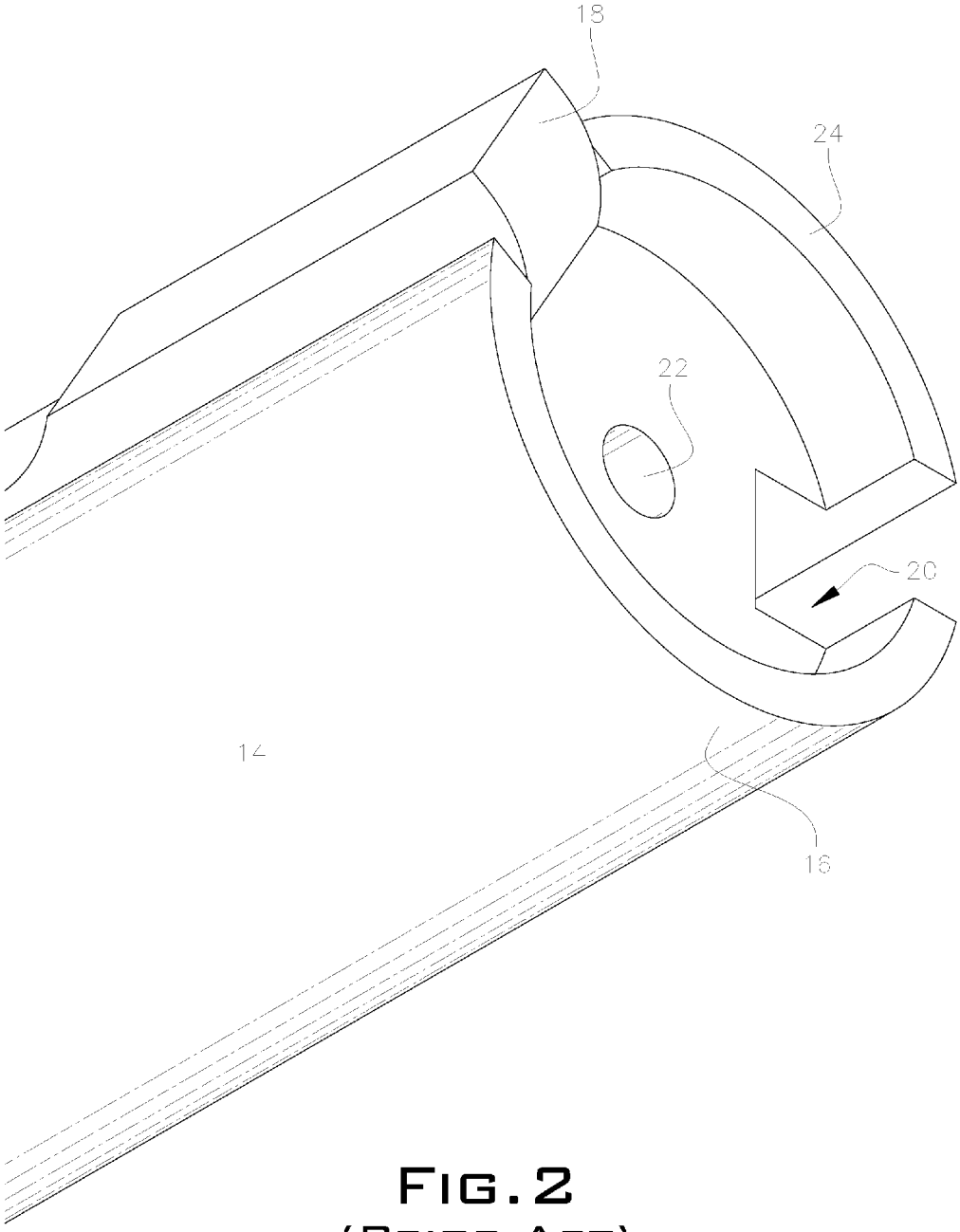
FIG. 2 (PRIOR ART)
FIG. 2 is a perspective view of the unmodified tip portion of the bolt as shown in FIG. 1.

Referring now to FIG. 2, the un-modified tip portion 16 of the elongated cylindrical portion 14 of bolt 10 is shown having extractor 18 and ejector slot 20. Also shown is a firing pin aperture 22. As can be clearly see, un-modified tip portion 16 has a circumferential upstanding wall portion 24 that surrounds a majority of un-modified tip portion 16, except for the area of the ejector slot 20, of which is formed therein.

Figure 3:
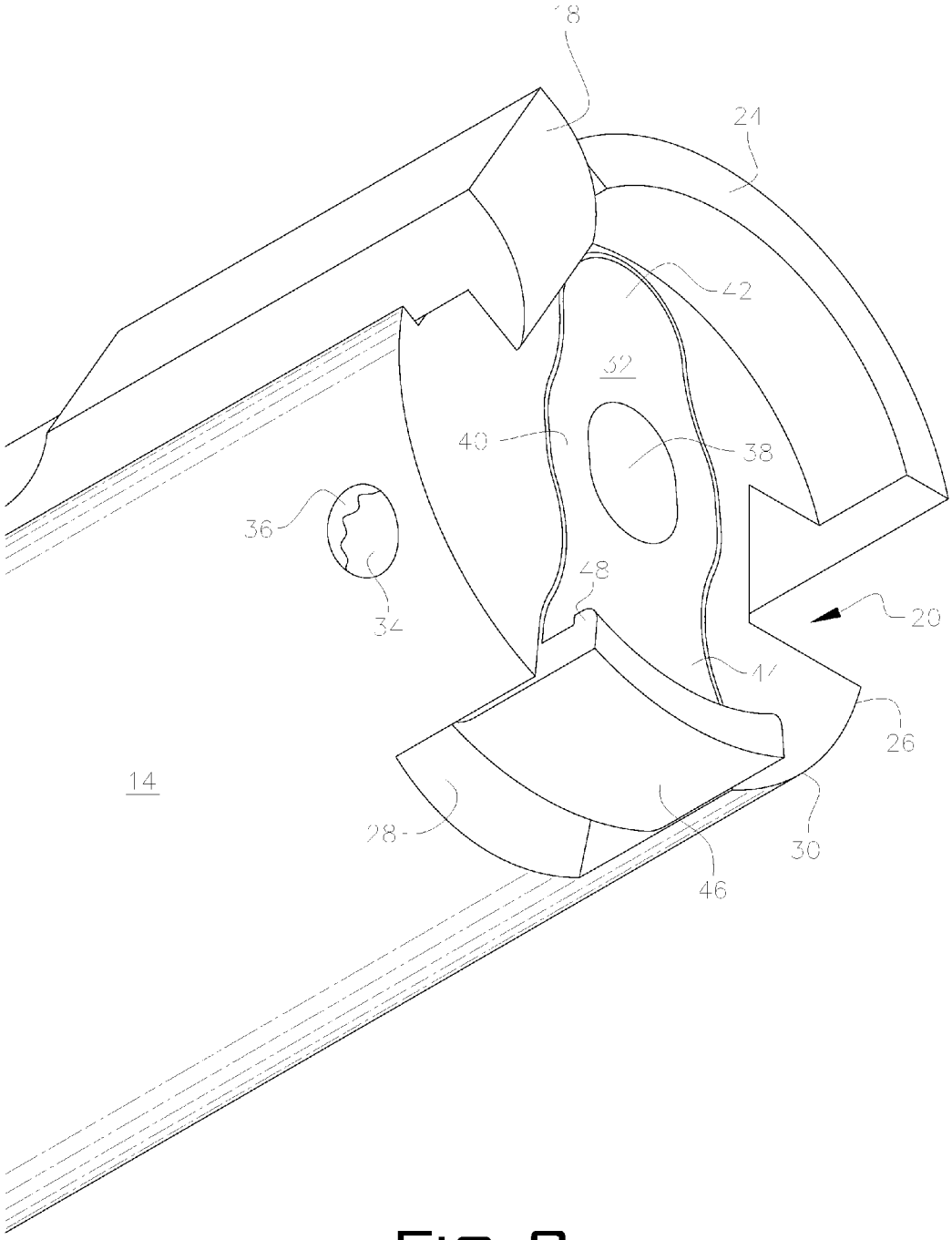
FIG. 3 is a perspective view of a modified tip portion of a bolt showing a novel pivoting plate used therein in its forward or non-collapsed position of the present invention.

Referring now to FIG. 3, a modified tip portion 26 of a bolt for use in my novel anti-jamming cartridge loading system of the present invention is shown. As illustrated, a large portion of the circumferential wall portion 24 has been removed. Further, a recess 28 has been formed along a bottom portion 30 of modified tip portion 26. A pivot plate 32 is positioned in the recess 28 and pivots about an axle 34 in the form of a pin and is held in place by welding 36. As further shown, pivot plate 32 has a firing pin aperture 38 that is axially aligned with a firing pin and the firing pin aperture 22 (both not shown in FIG. 3) so that the firing pin may protrude through both firing pin aperture 22 and pivot plate aperture 38 and strike a primer cap of a cartridge in the firing chamber when a trigger is pulled of a weapon that employs the novel present invention. Still further, pivot plate 32, in it preferred embodiment, has a certain curved shaped that bulges at a center area 40 around aperture 38, which then tapers slightly inwardly above center area 40 and then tapers slightly back outwardly at a top portion 42, which is then rounded, and also tapers slightly inwardly below center area 40, which then tapers back outwardly at a bottom portion 44 such that bottom portion 44 has a larger width at its terminal end than a terminal end of the rounded top portion 42. Still even further, an outwardly protruding lip 46 extends from the bottom terminal end of pivot plate bottom portion 44, which in turn includes an upwardly standing wall 48, which is used to assist in loading a cartridge in the firing chamber of the weapon, and clasping a lower rim portion of the round, as will be discussed in more detail hereinafter.

Figure 4:
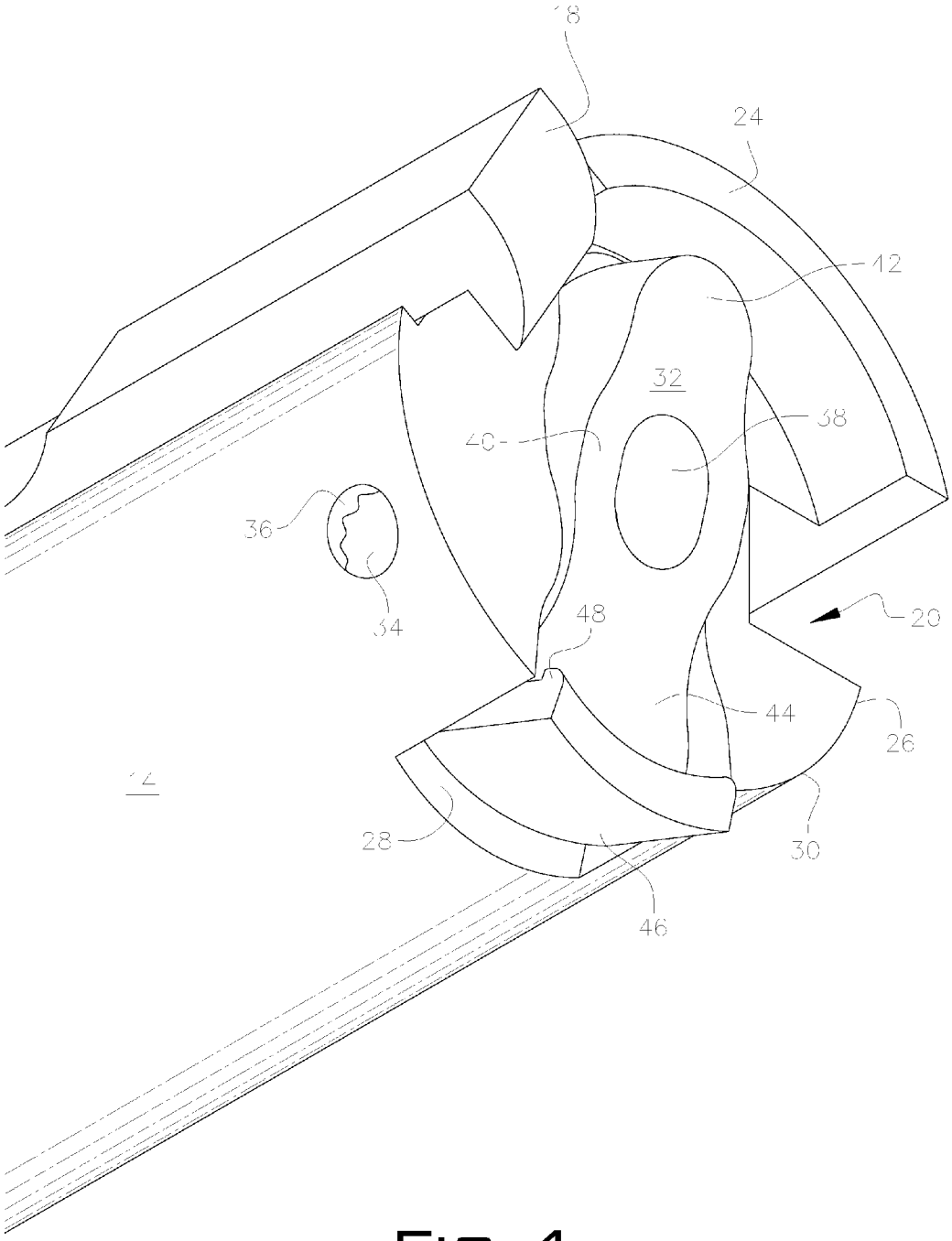
FIG. 4 is a perspective view of a modified tip portion of a bolt showing the novel pivoting plate used therein in its collapsed position of the present invention.

Referring now to FIG. 4, it is shown how the lower portion 44 of pivot plate 32 pivots upon axle 34 into the recessed area 28 when it is in its "collapsed" state. This collapsed state occurs when the bolt is moving forward by the stored energy of a recoil spring of a weapon, in which this novel invention is employed. The collapsed pivot plate 32 contacts the next cartridge (or round) in a magazine to be pushed up the feed ramp and chambered for "ready fire," as also will be more fully discussed hereinafter.

Figure 5:
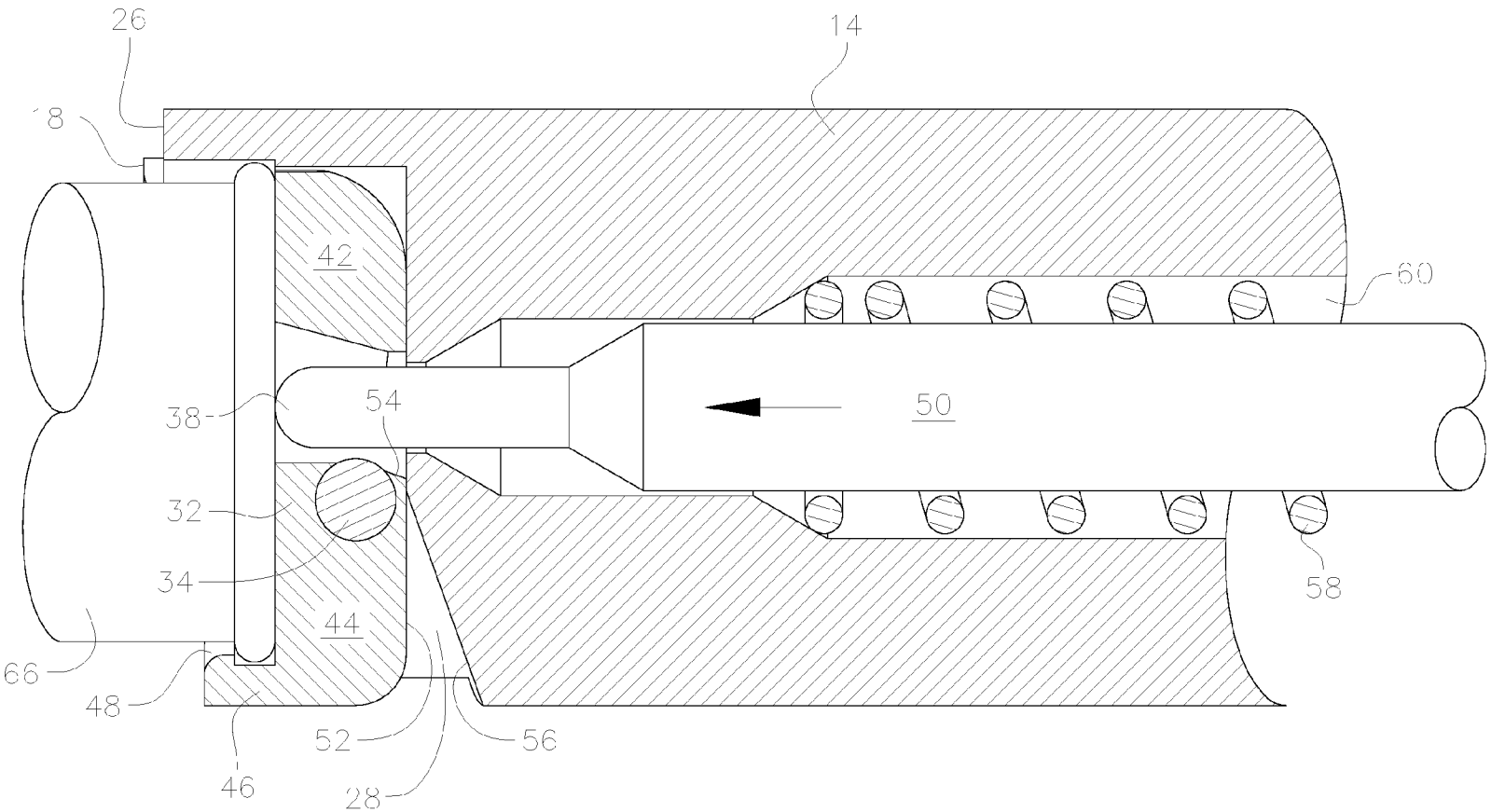
FIG. 5 is a cross-sectional view of the tip portion of the bolt showing a firing pin in a recessed position and the novel pivoting plate in its forward or non-collapsed position.
Figure 8:
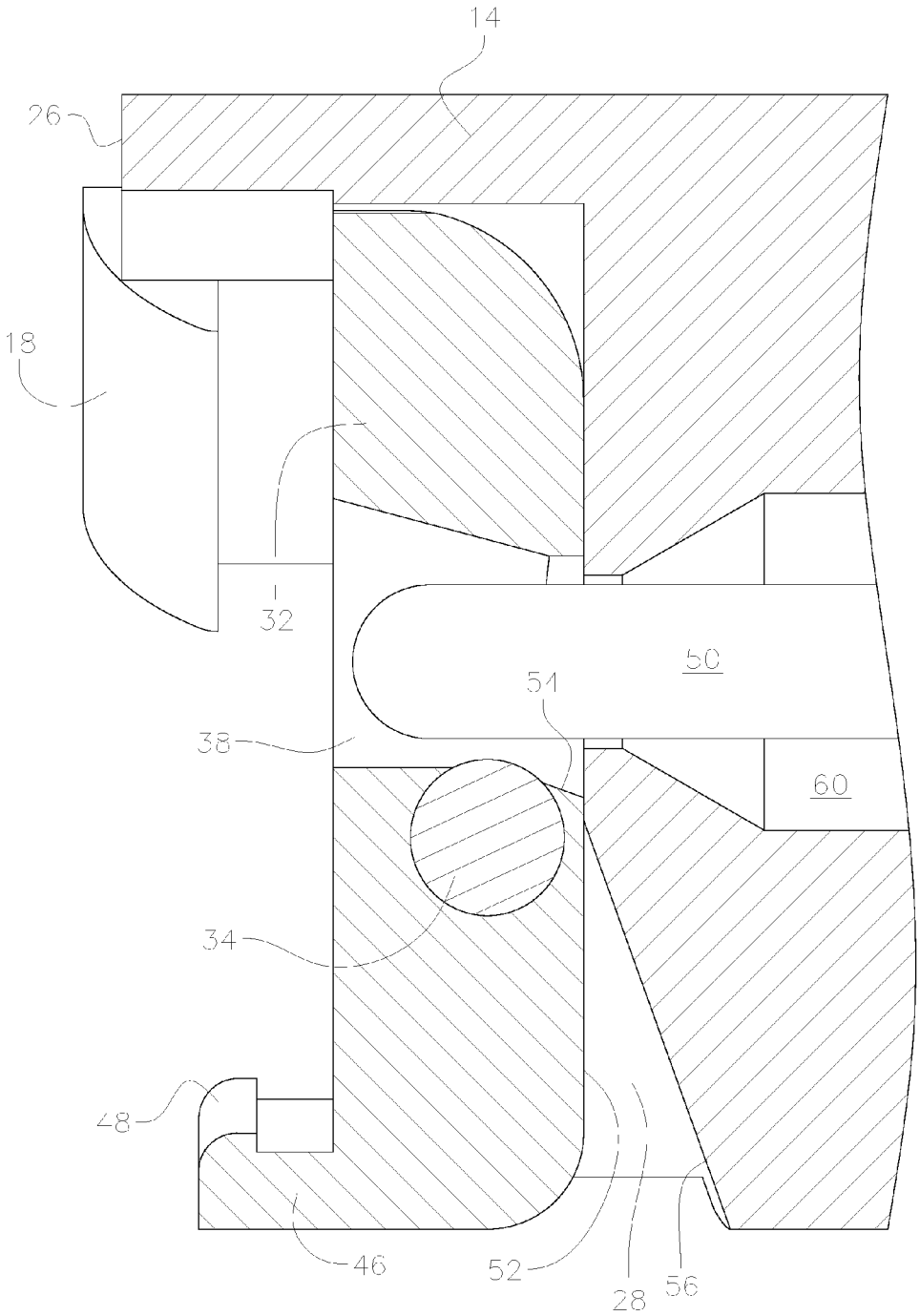
FIG. 8 is a cross-sectional view, in detail, of that which is shown in FIG. 5 illustrating that a clearance is formed in a rear wall of the pivoting plate along the firing pin hole of the pivoting plate.

Referring now to FIG. 5, a cross-sectional view of the elongated cylindrical portion 14 of the bolt is shown. Herein, pivot plate 32 is shown in its forward position (or "non-collapsed" state) on the modified tip portion 26 (nose bolt) of the present invention and a firing pin 50 is shown moving forward by the arrow pointing right to left to its firing position since it is protruding (from its recessed state) through pivot plate aperture 38. At the precise moment that firing pin 50 strikes a primer cap of a round 66, the bullet (not shown here) encased within this cartridge will fire. As further shown, along a back wall 52 of lower portion 44 of pivot plate 32, a small clearance 54 is formed near pivot plate aperture 38. Clearance 54 allows pivot plate 32 to collapse if firing pin becomes protruded in a "fixed fire" position due to malfunction or attempted illegal modification which would cause firing pin 50 to hang on the rim of the next attempted loaded round, thereby causing a jam (see FIG. 10). Also, as shown in FIG. 5, recess 28 has an angled back wall portion 56 along a lower part of recess 28 for permitting pivot plate 32 to rotate along axle 34 such that pivot plate 32 can "collapse" (see FIG. 6). With reference to FIG. 8, all of these same elements can be seen in this detail cross-sectional view taken directly from FIG. 5.

Figure 6:
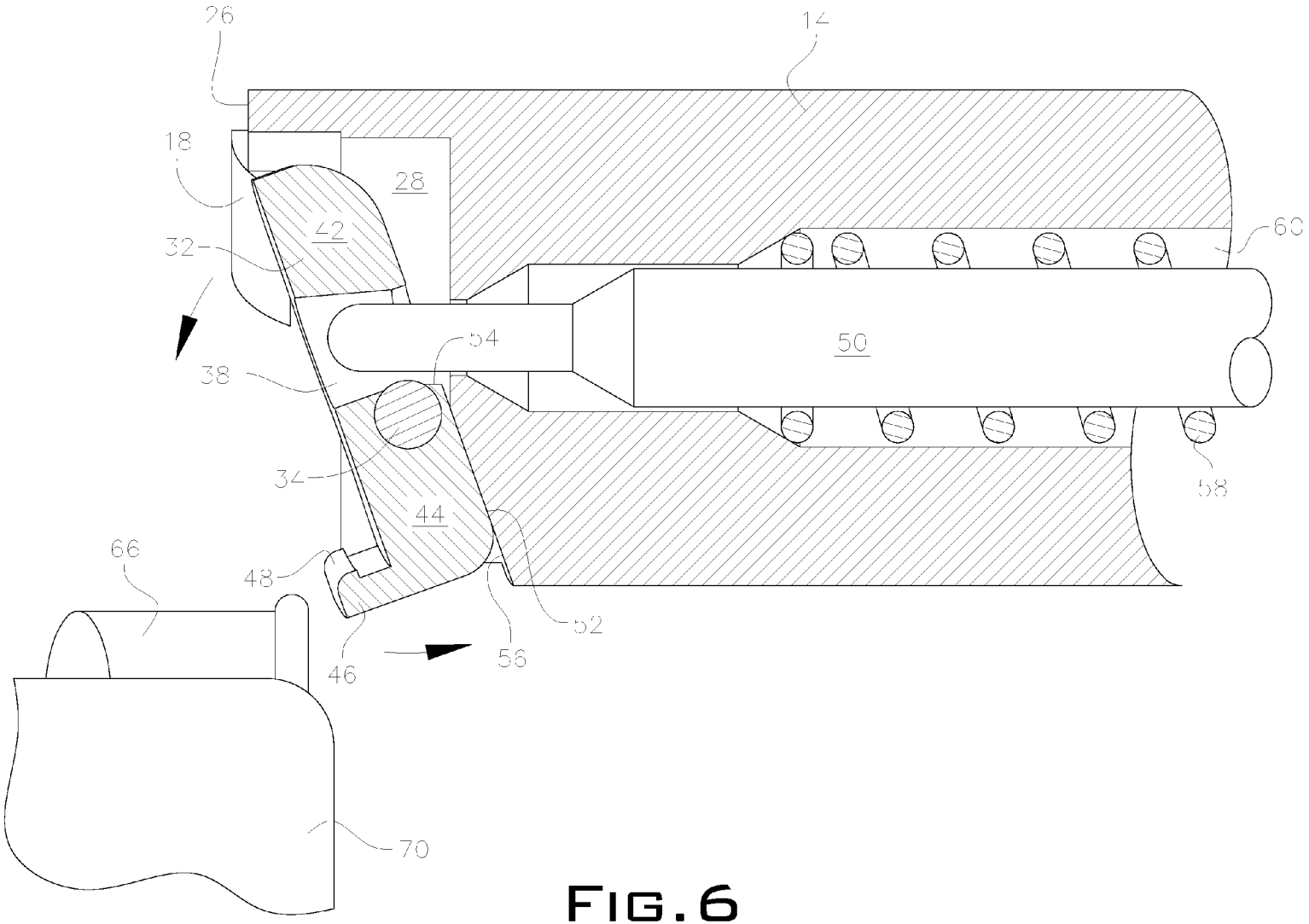
FIG. 6 is a cross-sectional view of the tip portion of the bolt showing the firing pin in its relaxed or retracted position and the novel pivoting plate in its collapsed position.
Figure 9:
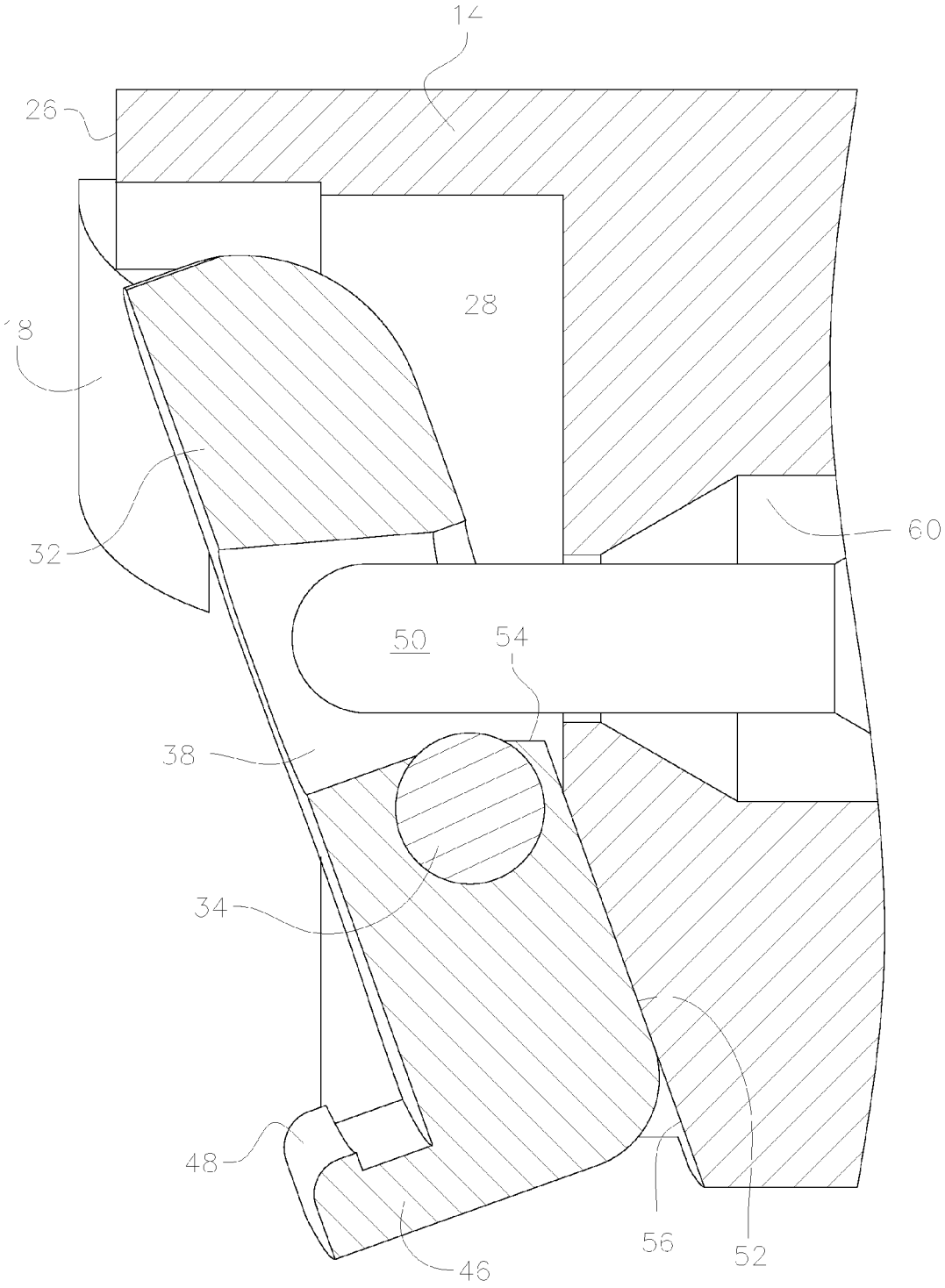
FIG. 9 is a cross-sectional view, in detail, of that which is shown in FIG. 6 illustrating again that a clearance is formed in a rear wall of the pivoting plate along the firing pin hole of the pivoting plate and that said clearance allows the pivoting plate to rotate or collapse when coming in contact with a fresh round when the bolt is moving forward after cycling rearward.

With reference now to FIG. 6, it is shown how pivot plate 32 "collapses" into recess 28 by rotating upon axle 34 and is set against angled back wall 56 upon the bolt moving forward to pick up the next round 66 from magazine 70 (it is understood that the word magazine used herein encompasses other cartridge feeding systems like drums). Thereafter, the pivot plate 32 must be able allowed to rotate when the firing pin 50 is extended to strike the primer of the next loaded cartridge, but only after the trigger is pulled again (as shown in FIG. 5). As shown in FIG. 6 though, and even more clearly seen in the detailed cross-sectional view of FIG. 9 (taken directly from FIG. 6), clearance 54 allows firing pin 50 to clear aperture 38 to "hang" or "jam" on the rim of round 66 when in it is on the feed ramp being pushed towards the chamber (not depicted here).

Figure 7:
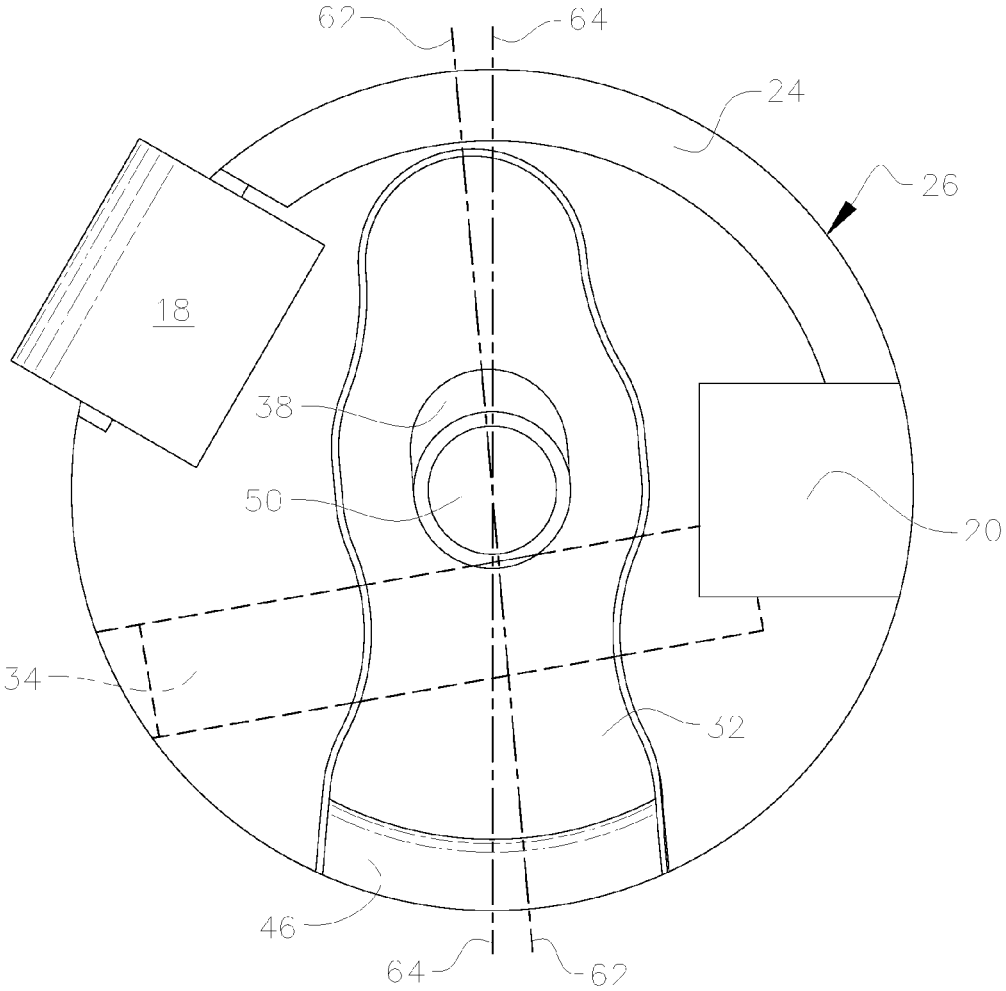
FIG. 7 is a front plan view of the modified tip portion of the bolt showing, in hidden lines, that a pivot pin used as the axle of the pivoting plate is slightly offset from a perpendicular axis of the bolt and positioned slightly below the a center line of the firing pin.

With reference now to FIG. 7, a front plan view of the modified tip portion 26 of the bolt of the present invention is shown. The hidden lines shown therein illustrate the position of pivot axle 34, which in the preferred embodiment is a pin held in place by welding. As clearly shown by the hidden lines representing pivot axle 34, it is angled (offset) downwardly from the right to the left side of modified tip 26. Pivot axle 34 is also positioned below a center line axis (not shown) of firing pin 50, which facilitates the locking of lower lip 46 of the pivot plate 32 to a rim of a cartridge when loaded into a closed battery situation (cartridge loaded in the breech of the carbine). Further, as shown in FIG. 7 by a first dash line, pivot plate 32 has a perpendicular axis 62 which is slightly offset to the right of a perpendicular axis 64 (second dash line) of the bolt nose. Also, as shown herein, the tip of the firing pin 50 can be seen how it is able to protrude through pivot plate aperture 38, when the weapon is fired.

Figure 10:
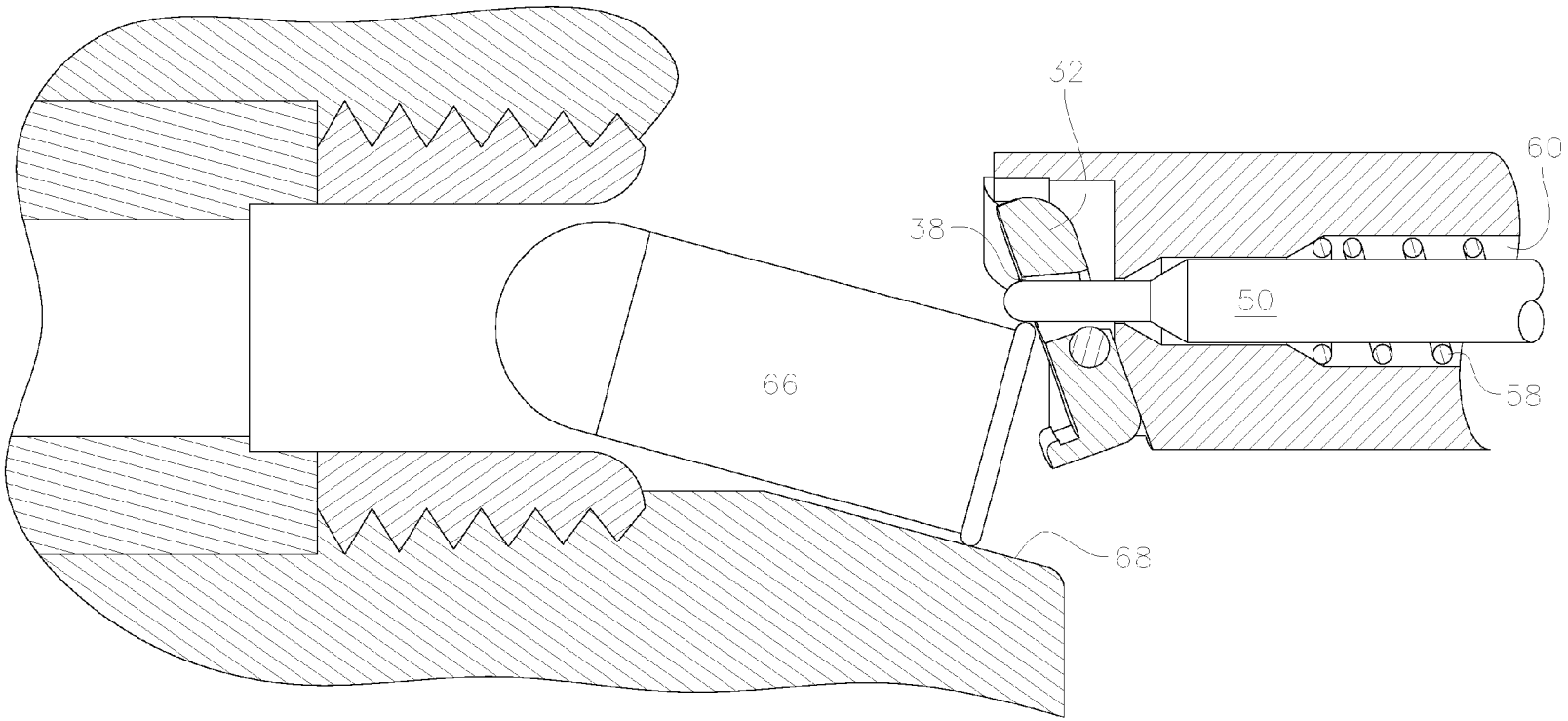
FIG. 10 is a cross-sectional view of both the tip portion of the bolt, employed in the present invention, as well as the feed ramp and firing chamber of the weapon illustrating how a cartridge to be loaded will jam in this position before it reaches the firing chamber if the firing pin protrudes through the pivoting plate firing pin hole because the firing pin has been fixed in a fire position.

Referring now to FIG. 10, a problem to be solved by the present invention is clearly shown. In particular, a the rim of round (or cartridge) 66 is shown "hung up" on the tip of the firing pin 50 along a feed ramp 68 because the firing pin 50 is in a fixed fire position (i.e., prematurely protruding through the pivot plate aperture 38). However, in contrast, as to the proper working operation of the present invention (i.e., the firing pin is not fixed in the fire position but instead recessed in a relaxed position by the pressure from the firing pin spring 58), and with incorporation by reference of teachings of my separately filed U.S. patent application Ser. No. 11/435,402, now U.S. Pat. No. 7,562,614, filed on May 17, 2006, and with a round 66 chambered in the breech of the weapon, the trigger of the weapon is pulled, releasing the hammer to strike the firing pin, which in turn strikes the primer of the cap of the round and fire the gun. Thereafter, the delayed blow back bolt (Blish lock) blows backward and the extractor 18 of the modified bolt tip 26, being locked to the bolt tip 26, then extracts the empty shell casing and ejects the empty shell casing and it is ejected out through the ejector slot 20. And then, from the teachings of my separately filed application as listed herein and incorporated by reference, a new round 66 is loaded into the breech of the weapon and the weapon is ready to fire again, so long as the trigger is once again pulled.

Of course, my novel anti-jamming cartridge loading system, as described herein, could be used with other fully-automatic to semi-automatic conversion systems than the one which I describe herein or in my separately field application, which I have incorporated by reference. Further, the present invention could be used with other weapons than a converted Thompson Submachine gun, which I have set forth herein merely as the preferred embodiment. In fact, this invention could be used with any single fire or semi-automatic carbine or long rifle employing an closed bolt system and/or a delayed blow back bolt, such as the Blish lock. In fact on a much larger scale, this system could be employed with a large round firing cannon or similar weapon.

Therefore, equivalent elements can be substituted for ones set forth herein to achieve the same results in the same way and in the same manner, of which do not take away from the scope of my novel, unique and clearly non-obvious anti-jamming cartridge loading system.

Having thus described the present invention in the detailed description of the preferred embodiment, what is desired to be obtained in Letters Patent is:

1. In a semi-automatic fire, closed bolt, delayed blow back-type carbine, wherein no lower feed lips are employed, an anti-jamming cartridge loading system comprising:

a) the closed bolt having a firing pin recessed within the closed bolt when the carbine is ready to fire;

b) the closed bolt having a nose bolt including an extractor mounted upon an outer end circumference thereof and an ejector slot formed in a side portion therein;

c) the nose bolt having a recess formed on a terminal end receiving a pivot plate, the pivot plate rotating about an axle such that the pivot plate is in a collapsed state before the bolt is in a ready fire position and the pivot plate is in a non-collapsed state when the bolt has reached its most forward position such that the firing pin protrudes through an aperture formed in the pivot plate far enough to strike a cartridge positioned in a breech area of the carbine.

2. The anti-jamming cartridge loading system of claim 1, wherein the firing pin will jam any subsequently attempted loaded cartridge before it reaches the carbine breech if the firing pin is fixed in forward fire position out through the pivot plate aperture.

3. The anti-jamming cartridge loading system of claim 1, wherein the pivot plate axle is positioned below a center line of the firing pin and is slightly off-set from an x and y axis of the nose bolt.

4. The anti-jamming cartridge loading system of claim 1, wherein the pivot plate has a vertical axis that is slightly off-set from a vertical axis of the nose bolt.

5. The anti-jamming cartridge loading system of claim 4, wherein the pivot plate vertical axis is off-set slightly to the right from the nose bolt vertical axis.

6. The anti-jamming cartridge loading system of claim 5, wherein the pivot plate vertical axis is off-set by up to 10 degrees.

7. The anti-jamming cartridge loading system of claim 1, wherein the pivot plate further includes an outwardly protruding lip portion of a bottom portion of the pivot plate, the lip portion having a small upwardly standing wall at its distal end.

8. The anti-jamming cartridge loading system of claim 1, wherein the nose bolt includes an downwardly depending angled back wall located in a lower portion of the recess, a lower back wall of the pivot plate seating against the downwardly depending angled back wall when the pivot plate is in a collapsed state.

9. The anti-jamming cartridge loading system of claim 1, further comprising a clearance formed in the pivot plate along a back wall thereof and proximal to the pivot plate aperture.

10. The anti-jamming cartridge loading system of claim 9, wherein the firing pin is permitted to protrude through the pivot plate aperture past the clearance when the pivot plate in its collapsed state.

11. In a fully-automatic machine gun converted to a semi-automatic carbine, wherein the conversion requires the removal of any or all parts of a feed lip element of the machine gun, an anti-jamming cartridge loading system comprising:

a) a bolt having a firing pin recessed therewithin when the converted semi-automatic carbine is ready to fire;

b) the bolt having a nose bolt including a means for extracting and ejecting a spent shell casing located upon an outer end circumference of the bolt nose;

c) the nose bolt having a recess formed on a terminal end receiving a pivot plate, the pivot plate rotating about an axle such that the pivot plate is in a collapsed state when the bolt is in a ready fire position and the pivot plate is in a non-collapsed state when the bolt has reached its most forward position such that the firing pin protrudes through an aperture formed in the pivot plate far enough to strike a cartridge positioned in a breech area of the converted semi-automatic carbine.

12. The anti-jamming cartridge loading system of claim 11, wherein the pivot plate axle is positioned below a center line of the firing pin.

13. The anti-jamming cartridge loading system of claim 11, wherein the pivot plate axle and is slightly off-set from an x and y axis of the nose bolt.

14. The anti-jamming cartridge loading system of claim 11, wherein the pivot plate has a vertical axis that is slightly off-set from a vertical axis of the nose bolt.

15. The anti-jamming cartridge loading system of claim 14, wherein the pivot plate vertical axis is off-set to the right of the nose bolt vertical axis by up to 10 degrees.

16. The anti-jamming cartridge loading system of claim 11, wherein the pivot plate further includes an outwardly protruding lip portion of a bottom portion of the pivot plate, the lip portion having a small upwardly standing wall at its distal end.

17. The anti-jamming cartridge loading system of claim 11, wherein the nose bolt includes an downwardly depending angled back wall located in a lower portion of the recess, a lower back wall of the pivot plate seating against the downwardly depending angled back wall when the pivot plate is in its collapsed state.

18. The anti-jamming cartridge loading system of claim 11, further comprising a clearance formed in the pivot place along a back wall thereof and proximal to the pivot plate aperture.

19. The anti-jamming cartridge loading system of claim 18, wherein the firing pin is permitted to protrude through the pivot plate aperture past the clearance when the pivot plate in its non-collapsed state.

20. The anti-jamming cartridge loading system of claim 11, wherein the converted fully-automatic machine gun is a Thompson submachine gun.

* * * * *